US007597779B2

(12) United States Patent
Gupta et al.

(10) Patent No.: US 7,597,779 B2
(45) Date of Patent: Oct. 6, 2009

(54) SHAKE MECHANISM FOR GLASS MAT PRODUCTION LINE

(75) Inventors: Hemant Gupta, Wayne, NJ (US); Adem Chich, Kearny, NJ (US); Sudhir Railkar, Wayne, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 388 days.

(21) Appl. No.: 11/431,136

(22) Filed: May 9, 2006

(65) Prior Publication Data

US 2006/0249267 A1 Nov. 9, 2006

Related U.S. Application Data

(60) Provisional application No. 60/679,106, filed on May 9, 2005.

(51) Int. Cl.
*D21H 13/40* (2006.01)
*D21F 1/18* (2006.01)

(52) U.S. Cl. ..... 162/156; 162/355

(58) Field of Classification Search ..... 162/123, 162/135, 145, 152, 156, 171, 209, 343, 354–356
See application file for complete search history.

(56) References Cited

U.S. PATENT DOCUMENTS 1,839,158 A * 12/1931 McDonnell ..... 162/209
3,012,929 A * 12/1961 Jackson ..... 162/145
3,047,444 A * 7/1962 Harwood ..... 428/153
4,055,460 A * 10/1977 Buchanan ..... 162/209
4,070,238 A * 1/1978 Wahren ..... 162/343
4,118,272 A * 10/1978 Ziegler et al. ..... 162/156
4,129,674 A * 12/1978 Hannes et al. ..... 442/373
4,234,379 A * 11/1980 Conway et al. ..... 162/145
4,265,704 A * 5/1981 Nahta ..... 162/156
4,294,655 A * 10/1981 Pfeffer ..... 162/107
4,472,243 A * 9/1984 Bondoc et al. ..... 162/135
4,513,045 A 4/1985 Bondoc et al.
4,810,576 A 3/1989 Gaa et al.

(Continued)

FOREIGN PATENT DOCUMENTS

DE 4031974 A1 10/1990

(Continued)

OTHER PUBLICATIONS

Smook, Gary A., Handbook for Pulp & Paper Technologists, Angus Wilde Publications, pp. 238-240 (1992).*

(Continued)

*Primary Examiner*—Eric Hug
(74) *Attorney, Agent, or Firm*—William J. Davis

(57) ABSTRACT

A shake mechanism is provided for shaking a breast roll at the wet end of a conventional glass mat machine. A method of producing a glass fiber mat is provided, the method involving combining glass fibers with a dispersant medium to form an aqueous slurry, and shaking the aqueous slurry to redistribute fibers from areas of high concentration to areas of lower concentration. A glass fiber mat production line is also provided, the production line comprising a slurry formation station for combining glass fibers with a dispersant medium to form an aqueous slurry, and a hydroformer for shaking the slurry to redistribute glass fibers from areas of high concentration to areas of lower concentration.

9 Claims, 7 Drawing Sheets

Hydroformer Schematic

U.S. PATENT DOCUMENTS

| | | | | | |
|---|---|---|---|---|---|
| 5,129,131 | A | | 7/1992 | Kimura et al. | |
| 5,540,986 | A | | 7/1996 | Kimura et al. | |
| 5,560,808 | A | * | 10/1996 | Graf | 162/209 |
| 5,865,003 | A | | 2/1999 | Klett et al. | |
| 6,054,022 | A | * | 4/2000 | Helwig et al. | 162/156 |
| 6,068,715 | A | | 5/2000 | Yokokita et al. | |

FOREIGN PATENT DOCUMENTS

| | | | | |
|---|---|---|---|---|
| DE | 4031974 | C2 | | 10/1990 |
| DE | 4229184 | A1 | | 9/1992 |
| DE | 19704730 | A1 | | 2/1997 |
| SU | 1177172 | | * | 9/1985 |

OTHER PUBLICATIONS

Voith Paper, "DuoShake", product brochure, Apr. 9, 2000.*

* cited by examiner

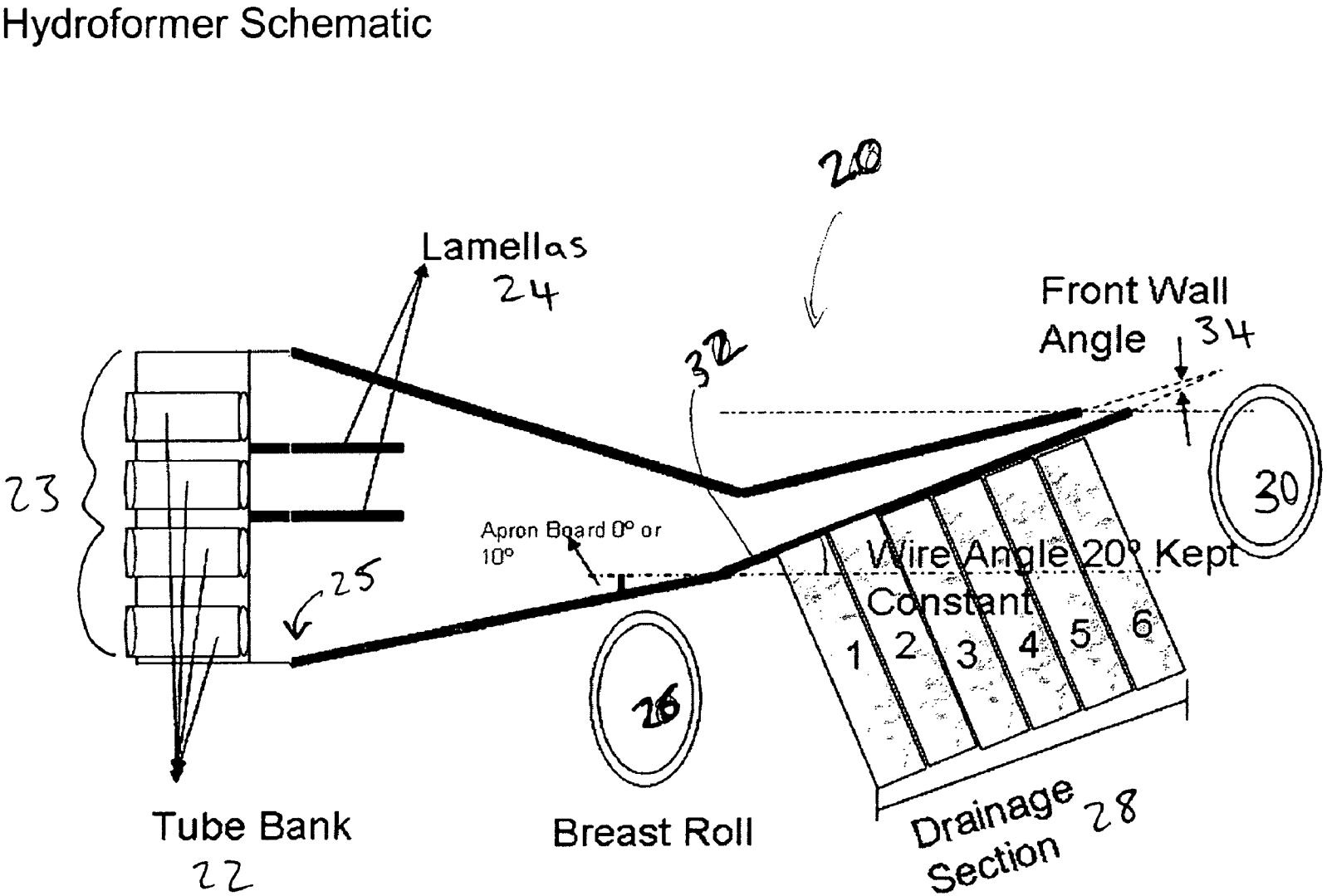
Hydroformer Schematic
Lamellas
24
Tube Bank
22
23
25
Apron Board 0° or 10°
Breast Roll
26
32
20
Wire Angle 20° Kept Constant
1
2
3
4
5
6
Drainage Section
28
Front Wall Angle
34
30

Fig. Front Wall Angle changed to 8°

Fig. Closing Initial Drainage Boxes

Note: Each value is an average of 3 samples; Standard Dev. for each expt. is also shown

- Formation deteriorated with the change in Front Wall Angle
- Thereafter, Formation improved with shake

- Formation deteriorated with shake at lower initial drainage

- Formation improved with shake with both RA = 10° and RA = 20°
- More improvement observed when RA = 10°

- Formation improved with shake when Lamellas are present or absent
- Lamellas does not improve formation on its own Note: Each value is an average of 6 measurements

- Caliper is generally lower by 5% – 10% for samples with Shake than without Shake.

-Shake Mechanism-

Formation Index (FI)

- Relative Angle = 10°, 20°
- Shake
- Lamellas F,G,H,I,J, K

Note: Each value is an average of 3 samples; Standard Dev. for each expt. is also shown

SHAKE MECHANISM FOR GLASS MAT PRODUCTION LINE

RELATED APPLICATIONS

This application claims priority to provisional application Ser. No. 60/679,106, filed May 9, 2005, the entire content of which is incorporated herein by reference.

BACKGROUND OF THE INVENTION

1. Field of the Invention

The present invention relates to glass mats, and more particularly, to glass fiber mats for application in roofing products such as asphalt shingles.

2. Prior Art

Asphalt roofing shingles are based on an interior web or carrier of a wet process glass fiber mat. Shingle manufacturing consists of running a continuous wet process glass fiber mat in a bath of molten asphalt to cause a coating on both sides of the mat as well as filling in the interstices between the individual glass fibers.

It is common in the art of manufacturing glass fiber mats, woven materials and other reinforcing materials to apply a binder to both assist in holding the reinforcing material together and promoting a better bond between a matrix resin and the reinforcing material during a subsequent RIM, RTM or SRIM molding process.

These binders are usually dry, powder resins, but can be emulsions or liquids. The fiber materials are produced in a conventional manner for the type of construction desired. Normally, the binders are applied to the reinforcements and then subjected to heating, to melt, or dry-before-melt, and sometimes to cure the binders. This process uses significant quantities of energy as the entire mass of reinforcing material needs to be heated to the required melting and/or drying and/or reaction temperatures. The binder can be unsaturated, cured or staged, depending on the application requirements.

Wet process glass fiber mats are conventionally made from glass fibers held together by a binder comprising a thermoplastic and thermoset polymer system. Typically, a binder is applied in a liquid form and dispersed onto the glass fibers through an applicator such as a curtain coater. Conventional wet processes strive to produce a uniform coating of binder on the glass fibers, and to produce a shingle with an even distribution of fibers. After the binder and glass fibers have been dried and cured in an oven, the glass fiber mat is gauged and cut as desired.

Unfortunately, such conventional binders are not always compatible with the asphalt used to coat the mats in asphaltic composites such as roofing shingles. This can cause processing difficulties, and can result in roofing shingles having poor tear strength and a loose coating.

Current technology for glass mat manufacturing process on commercially available Deltaformer™ formers produces a mat with variable properties, e.g., tensile strength properties in machine direction (MD) and cross machine direction (CMD), with MD tensile strength being higher than CMD tensile strength. Another problem that is frequently confronted in glass mat manufacturing process is basis weight variation across the CMD. This phenomenon is called sheet anisotropy. For a variety of reasons it would be desirable to provide glass mats having improved isotropy.

Shake mechanism has been used in pulp and paper industry and refers to a setup in which the forming wire in the wet-end section (also known as the wet forming section), which is located immediately after the headbox, is moved at some predetermined amplitude and frequency perpendicular to the machine direction (i.e., in the cross machine direction). In modern machines, this kind of movement is usually achieved by shaking the breast roll. The purpose of shaking the breast roll can improve the formation of the resulting fiber mat by redistribution of fibers from high concentration areas to low concentration areas and orient fibers in the cross machine direction. This movement of fibers is relatively easy, when they are in the fluidized state in the initial part of the forming section. Therefore, it is believed for this technology to produce positive results that it be applied on fibers which are in a state of flotation rather than being consolidated in the network structure, where their freedom to move around is restricted.

Shaking the breast roll has historically been done in the paper industry to produce an isotropic sheet with reduced basis weight variation. However, it has not been implemented in long glass fibers machines. Thus, it would be desirable to improve the quality of glass fiber mats to asphaltic composites such as shingles, and improve product performance in the areas of processing and tear strength.

SUMMARY OF THE INVENTION

The present invention provides a glass fiber mat production line that provides a shake mechanism for implementation on glass mat manufacturing lines. The glass mat produced on formers is used for making diverse roofing materials such as shingles, etc. Shake coupled with process modifications such as reducing the drainage in the initial drainage section of the former results in increased residence time for fibers to remain in fluidized state. Fluidized fibers have a higher tendency to orient themselves in the direction of shake and also to redistribute themselves from high concentration areas to low concentration areas, thereby reducing basis weight variation.

Accordingly, a method of producing a glass fiber mat is provided, the method comprising combining glass fibers with a dispersant medium to form an aqueous slurry, and shaking the aqueous slurry to redistribute fibers from areas of high concentration to areas of lower concentration. A breast roll can be used for shaking the slurry.

The method of producing a glass fiber mat further comprises forming a fabric after shaking the slurry and applying it on a moving wire, and draining the fabric in a drainage section. The method can further comprise shaking the fabric for a second time, and applying a binder to the fabric. Excess binder is then removed from the fabric. The method further comprises drying and curing the fabric to form a reinforced glass fiber mat, and coating the mat with hot asphalt to form a shingle.

Further, a glass fiber mat production line is provided, the production line comprising a slurry formation station for combining glass fibers with a dispersant medium to form an aqueous slurry, and a hydroformer for shaking the slurry to redistribute glass fibers from areas of high concentration to areas of lower concentration.

The glass fiber mat production line further comprises a headbox in the hydroformer, where a tube bank is provided in the headbox for delivering the slurry from the slurry formation station to a converging section of the hydroformer, and spreading the slurry evenly across a machine direction of the hydroformer. One or more lamellas provided at different heights across the widths of the hydroformer create a layered substrate by partitioning the slurry into different streams.

The glass fiber mat production line further comprises a shake mechanism for shaking the slurry coming out of the converging section of the hydroformer. The shake mechanism comprises a breast roll. The slurry is landed onto a moving wire around the breast roll to form a fabric. A drainage section is provided for draining the water from the fabric through holes in the fabric.

The glass fiber mat production line further comprises a second shake mechanism for shaking the fabric after exiting the drainage section. A binder saturation station is provided for applying a binder to the fabric and removing excess binder solution and water from the fabric. The glass fiber mat production line further comprises an oven drying and curing station for drying the fabric in an oven, and a gauging and fabrication station for coating the fabric with an asphalt to form shingles.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

These and other features, aspects, and advantages of the apparatus and methods of the present invention will become better understood with regard to the following description, appended claims, and accompanying drawings where:

FIG. 2 illustrates a schematic representing the interior section of a hydroformer.

FIG. 3(*b*) illustrates a measure of formation index with the initial drainage boxes of the hydroformer closed.

DETAILED DESCRIPTION OF THE PREFERRED EMBODIMENT

Although this invention is applicable to numerous and various types of fiber mats, it has been found particularly useful in the environment of glass fiber mats for application in roofing products such as asphalt shingles. Therefore, without limiting the applicability of the invention to the above, the invention will be described in such environment.

The present invention can be used on any wet-laid process using any non-woven fibers, which requires filtration and sedimentation mechanism for water removal from the slurry of fibers.

Figure 1:
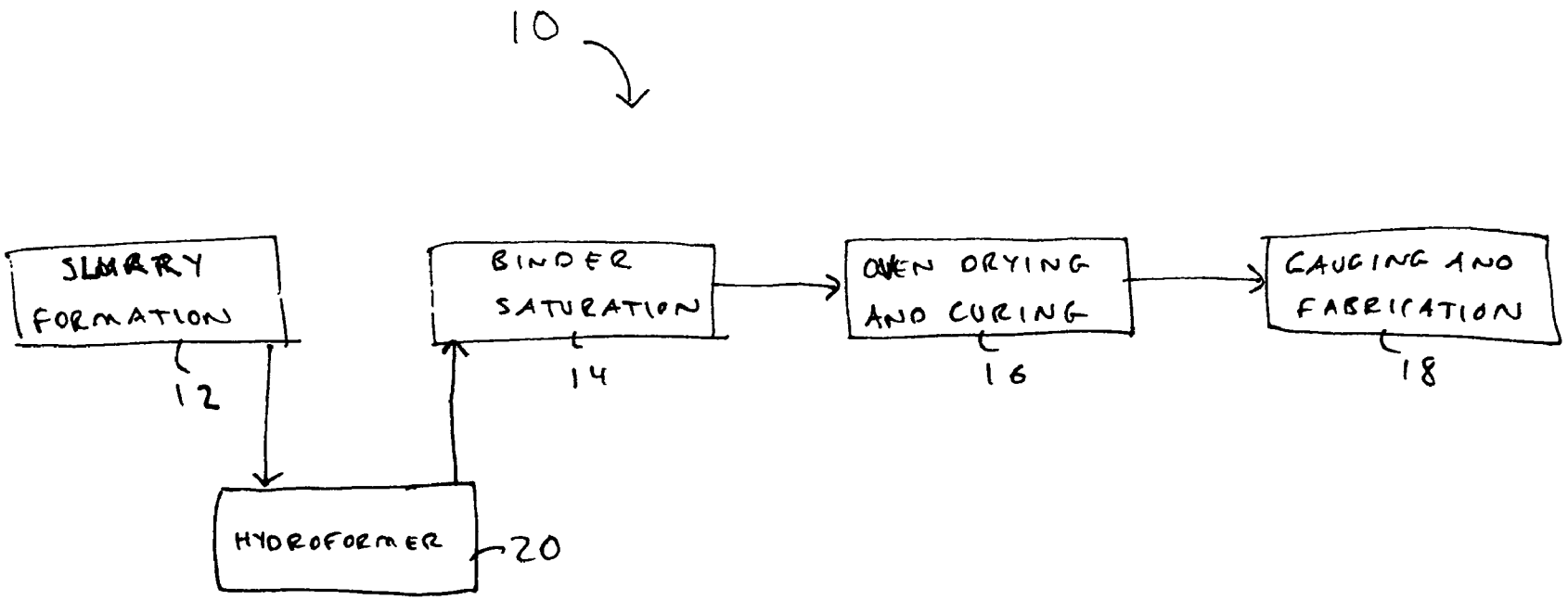
FIG. 1 is a flow diagram of a wet process for forming a glass fiber mat according to the present invention.

A wet process is generally used for forming a glass fiber mat according to the invention, as shown in FIG. 1. Preferably the process is a conveyor-based operation wherein a desired product-in-process travels between different stations on a conveyor system and results in a finished glass fiber mat at the end of the process.

Glass fibers are an essential ingredient for forming a glass fiber mat according to the process. Typically, glass fibers are formed, chopped, packaged and delivered for use in the process. Any conventional process can be used to make the glass fibers. One such process is known as the rotary process, in which molten glass is placed into a rotating spinner which has orifices in the perimeter, wherein glass flows out the orifices to produce a downwardly falling stream of fibers which are collected on a conveyor. A second fiber forming process is a continuous process in which glass fibers are mechanically pulled from the orificed bottom wall of a feeder or bushing containing molten glass. Substantially contemporaneous with forming, the glass fibers are brought into contact with an applicator wherein a size is applied to the fibers. The sized glass fibers are then chopped to a specified length and packaged. The process of forming glass fiber mats according to the invention begins with glass fibers of suitable length and diameter. Generally, fibers having a length of about ¼ inch to 3 inches and a diameter of about 3 to 20 microns are used.

Slurry formation occurs during station 12 of the process. Preferably, the glass fibers are dispersed into a water solution and carried by a conveyor. The fibers are added to the dispersant medium to form an aqueous slurry. Any suitable dispersant known in the art may be used. The fiber slurry then is agitated to form a workable dispersion at a suitable consistency.

In the present invention, a shake mechanism is provided between station 12 and station 14. After the slurry formation 12 in FIG. 1, the liquid stock (fiber+water+air) enters a hydroformer 20. FIG. 2 shows an entire schematic representing the interior section of a hydroformer 20, or Deltaformer™.

A simplistic hydroformer schematic is shown in FIG. 2, which has a tubebank section 22 (as in hydraulic former) through which liquid stock (fibers+water+air) is delivered to the converging section of the hydroformer 20. A modification of this setup could be an air-padded system in which tube bank section 22 is absent. Lamellas 24 are optional horizontal sheets placed at different heights across the width of the hydroformer 20. The lamellas 24 are generally used to create a layered substrate by partitioning feed stock into different streams.

The liquid stock (fibers+water+air) enters from the left side of FIG. 2 from the slurry formation station 12 into the headbox 23, which includes the tube bank section 22. The function of the tube bank 22 is to spread the stock evenly across the cross machine direction of the hydroformer 20. Then the liquid stock enters the converging section 25, which can be angled from 0-45 degrees, and is preferably angled between 0-10 degrees.

In the converging section 25, velocity of the stock increases as open area through which stock flows decreases. A shake mechanism is provided by shaking breast roll 26, as shown in FIG. 2. The intensity of the shake is maximum closest to the breast roll 26 on which it is applied. Then, stock lands onto a moving wire 32 (forming fabric, not shown in the figure) wound on one side around breast roll 26.

Thereafter, the intensity of the shake diminishes as the fabric moves down the wire 32. The angle of the wire 32 can be between 0-45 degrees, and is preferably around 20 degrees. The forming fabric has holes through which water in the stock/slurry drains out in the drainage section 28, thereby consolidating the mat (increase in solids content) as the mat moves past drainage legs 1-6.

Therefore, another shake is proposed to continue the movement of the wire 32 for a longer while on breast roll 30. For a shake to be effective it is imperative that the fibers are in fluidized state. If only breast roll 26 is shaken then there is less impact on the sheet formed once the mat comes off the drainage section 28 because most of the water is already removed by that time and fibers are consolidated in a mat structure.

The position of breast roll 30 should be such that the fibers moving on the wire 32 close to it should be in a fluidized state as well. Secondly, with shaking the breast roll 26 only, fibers in the lower layers of the substrates are affected. However, with another shake on breast roll 30, fibers in the top layers will be influenced as well because these fibers are in fluidized state for a longer time. The invention is not limited to one or two shakes provided by breast rolls 26 and 30, and multiple shakes can be put in different sections down the machine direction away from the breast roll 26 to influence different layers. After breast roll 30, the mat goes to the binder station 14, as shown in FIG. 1.

Binder saturation occurs during station 14. A desired liquid binder is stored in a reservoir or tank, and is applied to the glass fibers in the unbonded mat received from station. One preferred binder according to this invention comprises urea-formaldehyde and latex. The binder, preferably in liquid form, is pumped from a reservoir and applied to the unbonded mat, preferably through an applicator. A pump can deliver binder from the tank to the applicator. The applicator can span a desired portion of the width of the unbonded mat and apply binder as the glass fibers pass beneath it. A vacuum removes excess binder solution and excess water and wrinkles that may be present from the treated mat. The vacuum can remove excess binder and return it to the tank or dispose of it as desired. The amount of vacuum applied to the treated mat will affect the amount of liquid, and therefore the amount of binder carried in the unbonded mat, that will be removed. Increased vacuum removes a greater amount of liquid, resulting in a lower concentration of binder remaining with the glass fibers in a treated mat.

The treated mat passes from station 14 to an oven or the like in the drying and curing station 16. The treated mat is heated for a desired time in an oven or the like so that the binder will cure and form a reinforced glass fiber mat. The mat is dried and the binder composition is cured in an oven at elevated temperatures, generally at least at about 400° F.

Gauging and fabrication occur during station 18. At the fourth station, the glass fiber mat can be measured for various properties and prepared for shipment. The glass fiber mat can be coated with asphalt in a well known manner and cut to form shingles. After the glass fiber mat has been formed and cured, it can be passed through a process which involves coating the mat with hot asphalt to form a roofing product such as roofing shingles. The glass fiber mat can be cut as desired at station 18 by such means as a rotary blade or water jet.

In a preferred embodiment, the glass mat machine can operate at speeds greater than 1000 feet per minute. The preferred amplitude and frequency of the shake can be determined by routine testing. In a preferred embodiment, the shake frequency is 150-600 strokes/minute. The shake stroke can range up to about 25 mm.

The Deltaformer™ is a proven high dilution hydroformer that has been used to produce a wide variety of nonwovens and specialty paper sheets. When using inorganic or organic fibers with long fiber lengths, large volumes of water must be used to disperse the fibers and to keep them from entangling with each other. The Deltaformer™ is designed to handle long fiber stocks that have to be formed at low consistencies. The Deltaformer™ design features allow for high hydraulic drainage capacities needed to produce a variety of durable and disposable nonwovens.

The stock inlet system is custom designed for each application, using CFD modeling, to ensure an even flow distribution across the headbox resulting in a uniform basis weight profile of the sheet.

The Deltaformer™ features a vacuum forming box with multiple compartments, each equipped with an individual system for flow and vacuum control. This permits controlled drainage for the best formation and control of sheet properties.

The wire section of the Deltaformer™ can be cantilevered for easy fabric changing. The wire incline can be fixed in the optimum position for each application. An incline of 15° to 35° is typical. The adjustable angle gives greater flexibility to control formation and sheet squareness particularly for highly diluted stocks running at slow speeds.

Some of the main features of the Deltaformer include that the inclined wire former 32 can have an angle that ranges from 15° to 35°. The Deltaformer can have high dilution forming up to 600 l/min/cm. The Deltaformer can further form synthetic fibers up to 38 mm long, machine widths up to 5 meters wide, and machine speeds up to 600 m/min.

Figure 3A:
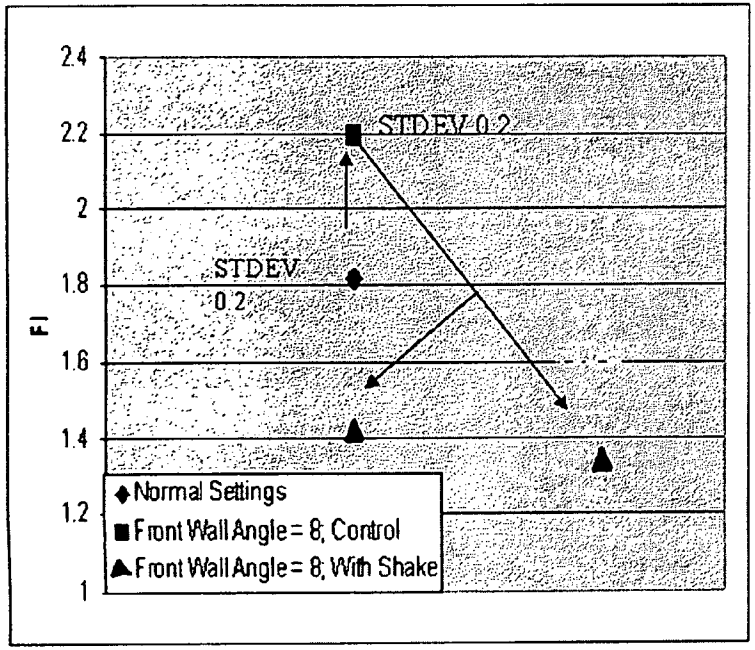
FIG. 3(*a*) illustrates a measure of formation index with the front wall angle of the hydroformer at 8 degrees.
Figure 3B:
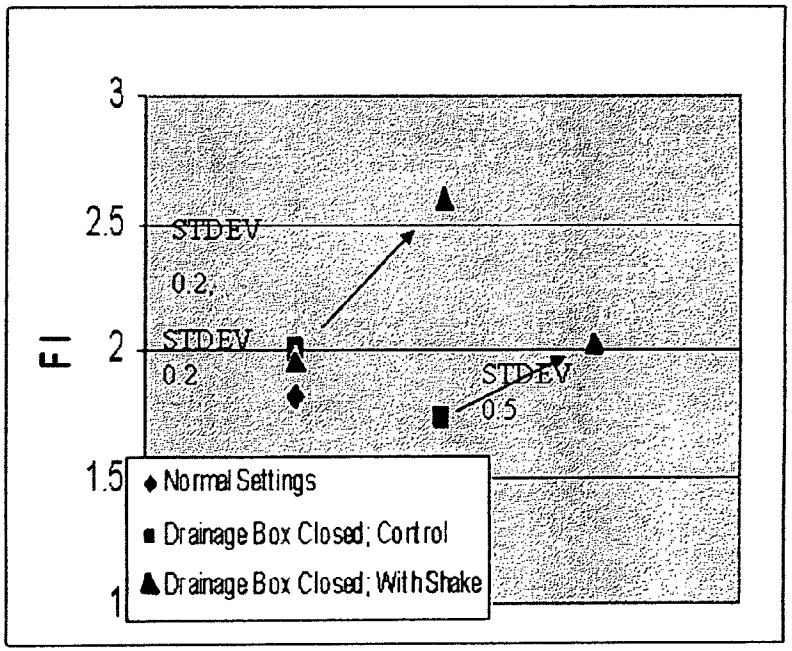

Various experiments and trials were run. Experiments were conducted changing the front wall angle, as shown in FIG. 3(*a*). In FIG. 3(*a*), the front wall angle was changed to 8 degrees. As can be seen on the graph, the formation deteriorated with the change in the front wall angle. Thereafter, the formation improved with shake. In FIG. 3(*b*), the initial drainage boxes were closed in drainage section 28. As can be seen, the formation deteriorated with shake at lower initial drainage.

Figure 4:
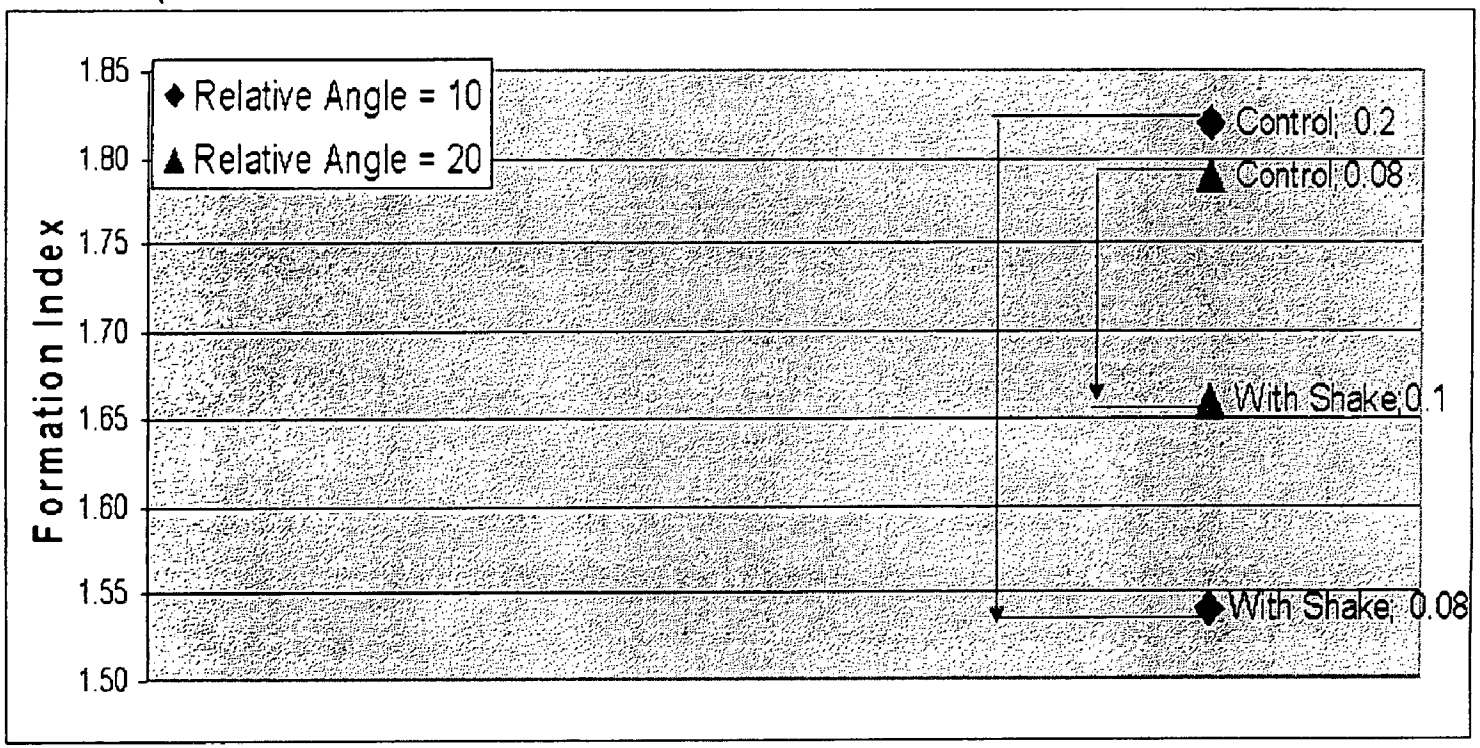
FIG. 4 illustrates a measure of formation index with the apron board angle of the hydroformer at 10 degrees and the front wall angle of the hydroformer at 20 degrees.

In FIG. 4, the wire angle was kept at 20 degrees and the apron board angle at 10 degrees, and the change with shake was observed. As can be seen, the formation improved with shake when the apron board angle was 10 and the wire angle at 20 degrees, but more improvement was observed when the apron board angle was 10 degrees.

Figure 5:
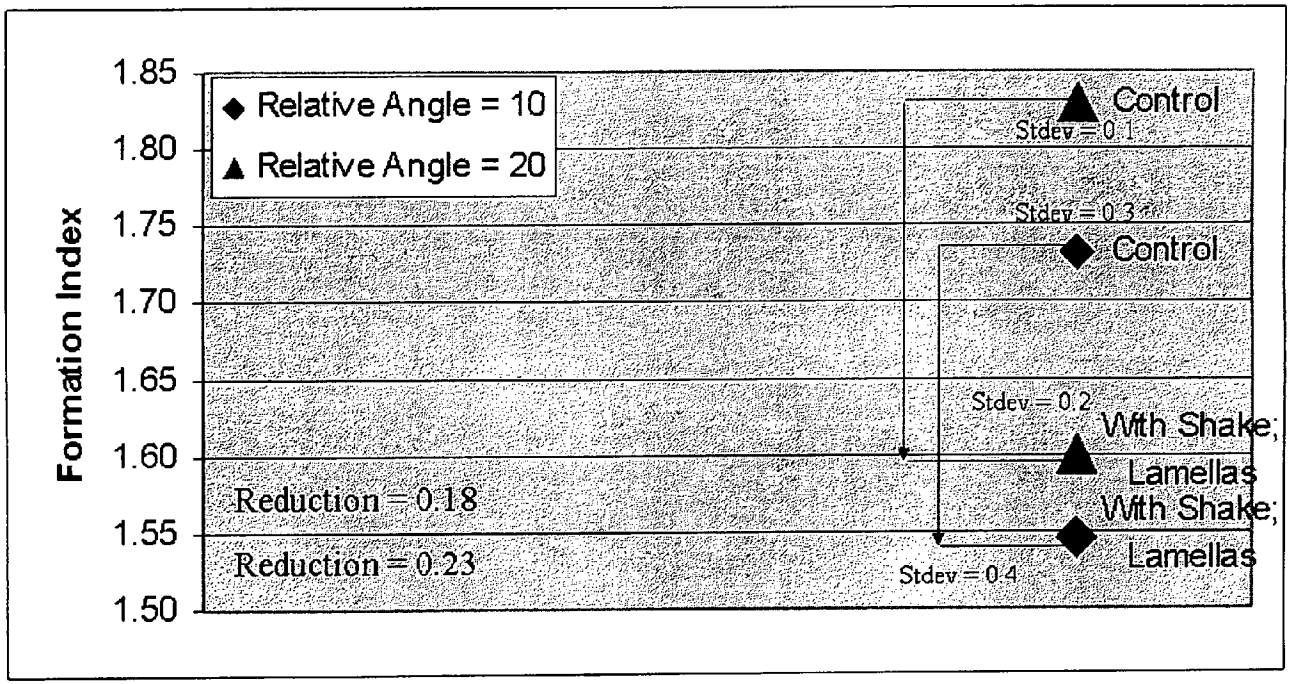
FIG. 5 illustrates a measure of formation index with shake when lamellas are present or absent in the hydroformer.

In FIG. 5, the shake was observed and formation measured with and without the lamellas 24. The formation was improved with shake when lamellas 24 were present or absent. Thus, the lamellas did not improve formation on its own.

Figure 6:
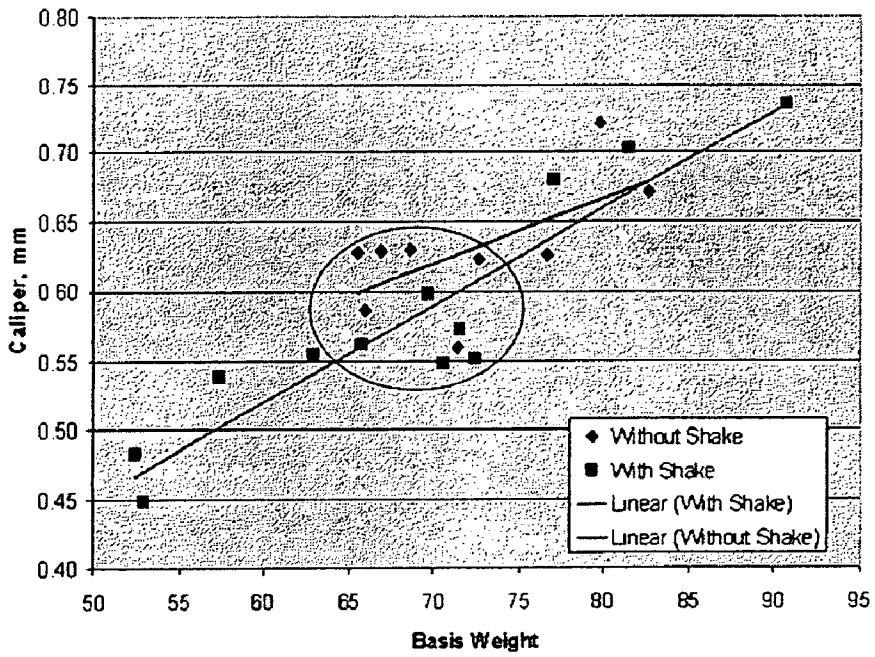
FIG. 6 illustrates a measure of caliper with and without shake.

In FIG. 6, the caliper was measured with and without shake. It was observed that the caliper was generally lower by 5%-10% for samples with shake than without shake. Each value on the graph is an average of 6 measurements.

Figure 7:
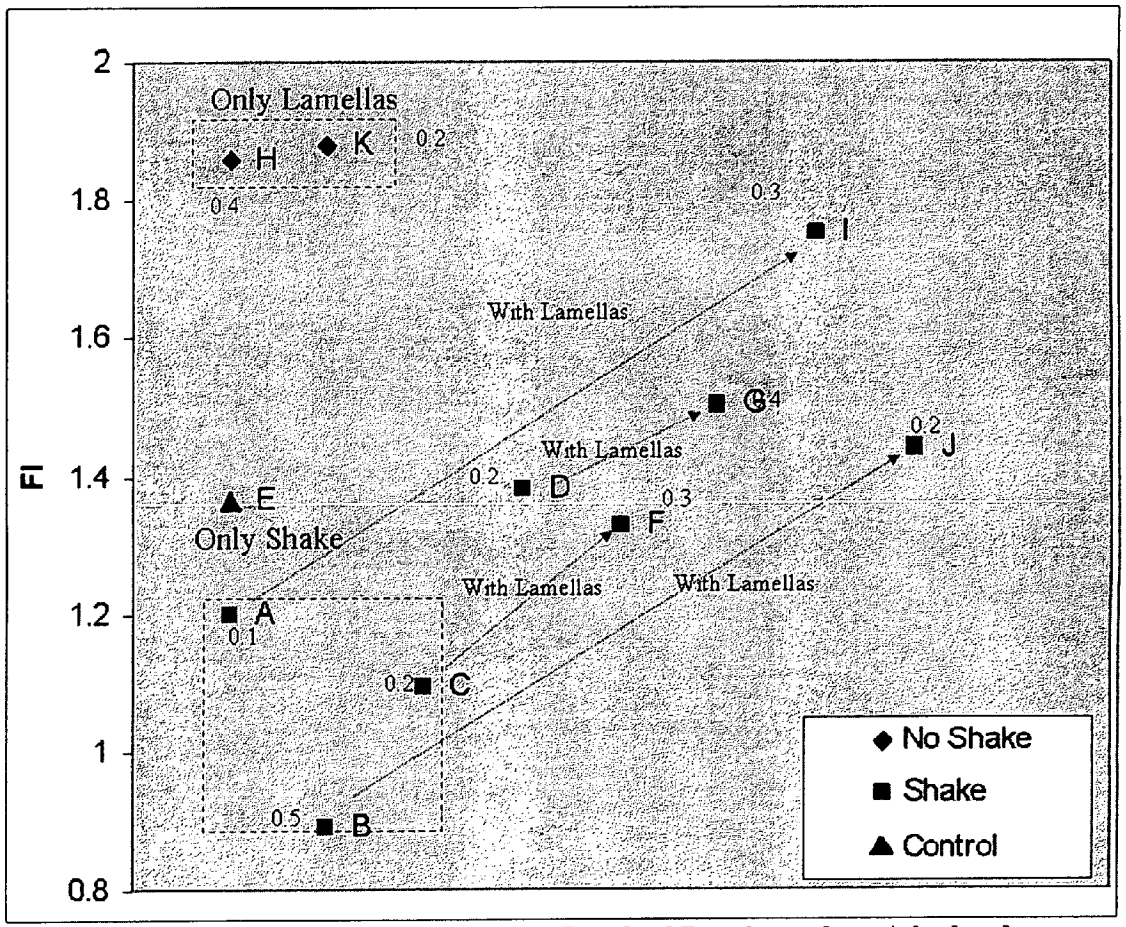
FIG. 7 illustrates a measure of formation index with and without shake, with lamellas and with only lamellas, and with the apron board angle of the hydroformer at 10 degrees and the front wall angle of the hydroformer at 20 degrees.

In FIG. 7, the formation index was measured with lamellas, only lamellas, only shake, and with shake. The wire angle was at 20 degrees and the apron board angle at 10 degrees. Each value on the graph is an average of 3 samples, and the standard deviation for each experiment is also shown.

In conclusion of the trials and experiments, it was found that non-uniformity in the mat by changing the front wall angle in the hydroformer can be controlled using shake. It was found that higher non-uniformity was observed with the initial drainage boxes shut, which deteriorates with shake.

Shake improved the formation in all cases. Shake/amplitude frequency should be optimized, and a second shake helps even more. A reduction in caliper was also observed with shake. Further, a better formation was observed with a lower relative angle (apron board angle at 10 degrees and wire angle at 20 degrees). Lamellas had no significant impact on the formation but had an adverse impact on caliper. Efficient mixing dramatically improved the formation.

In a sample run, the basis weight variation in the glass mat trials was reduced by 15% by reduction of drainage in the initial drainage boxes. Trials were conducted (by reducing drainage in drainage boxes and partially reducing drainage boxes flow) and it was observed that there was reduction in basis weight variation across the cross machine direction of the glass mat. Increasing the residence time for fibers in the fluidized state resulted in redistribution of fibers in the lower concentration areas, which reduced basis weight variation. Enhanced redistribution can be accomplished by complementing fluidized fibers with lateral shaking in the plane of the mat. The fluidized nature of the fibers imparts them freedom to move, while shake provides the necessary impetus to overcome resistance due to their moment of inertia and align themselves in a more random pattern.

Shake coupled with process modifications such as reducing the drainage in the initial drainage section of the Deltaformer™ former results in increased residence time for fibers to remain in fluidized state. Fluidized fibers have a higher tendency to orient themselves in the direction of shake and also to redistribute themselves from high concentration areas to low concentration areas, thereby reducing basis weight variation. A similar effect is obtained by using other drainage reducing equipment such as undulating drainage foils, e.g., Velocity Induced Drainage (VID) foils in the drainage section, by using smaller dimension fibers, viscosity modifiers, lamellas or any other drainage controlling equipment or technology.

The present invention provides several advantages that solve the problems with prior art methods. The main advantages of shaking the breast roll 10 for glass mat forming processes include increasing isotropy by orienting more fibers in the cross machine direction, reducing basis weight variation, reducing caliper and caliper variation, increasing drainage in the wet end, improving strength properties by consolidating the sheet structure, reducing the drying load on the dryer section, leading to even distribution of binder due to uniformity in the fiber distribution, leading to even coating (asphalt) pickup during conversion of glass mat into roofing products such as shingles etc., and that the process can be used on other similar manufacturing lines, which uses fibers in the slurry.

The above description of the present invention is only the preferred embodiment of the invention. Embodiments may include any currently or hereafter-known versions of the elements described herein. Further, the invention is not limited to fiber mats but to all types of mats roofing products, including but not limited to glass mats, polyester mats, any combination thereof, including scrim and glass strand reinforced mats.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method of producing a glass fiber mat, the method comprising:

combining glass fibers with a dispersant medium to form an aqueous slurry; and shaking the aqueous slurry to redistribute fibers from areas of high concentration to areas of lower concentration;

forming a fabric after shaking the slurry and applying it on a moving wire; and shaking the fabric for a second time.

2. The method of producing a glass fiber mat of claim 1, further comprising:

applying a binder to the fabric.

3. The method of producing a glass fiber mat of claim 2, further comprising:

removing excess binder from the fabric.

4. The method of producing a glass fiber mat of claim 3, further comprising:

drying and curing the fabric to form a reinforced glass fiber mat.

5. The method of producing a glass fiber mat of claim 4, further comprising:

coating the mat with hot asphalt to form a shingle.

6. A glass fiber mat production line comprising:

a slurry formation station for combining glass fibers with a dispersant medium to form an aqueous slurry;

a hydroformer for shaking the slurry to redistribute glass fibers from areas of high concentration to areas of lower concentration;

wherein the slurry is landed onto a moving wire around the breast roll to form a fabric; and a second shake mechanism for shaking the fabric after exiting the drainage section.

7. The glass fiber mat production line of claim 6, further comprising:

a binder saturation station for applying a binder to the fabric and removing excess binder solution and water from the fabric.

8. The glass fiber mat production line of claim 7, further comprising:

an oven drying and curing station for drying the fabric in an oven.

9. The glass fiber mat production line of claim 8, further comprising:

a gauging and fabrication station for coating the fabric with an asphalt to form shingles.

* * * * *